US006033416A

United States Patent [19]

Louison et al.

[11] Patent Number: 6,033,416

[45] Date of Patent: Mar. 7, 2000

[54] DEPILATORY DEVICE WITH ROTARY ROLLER

[75] Inventors: Bernard Louison, Francheville; Bernard Beillard, Sainte Foy Les Lyon; Yves Rosson, Villars les Dombes, all of France; Moshe Dolev, Ra'anana, Israel

[73] Assignee: SEB S.A., Ecully, France

[21] Appl. No.: 09/142,232

[22] PCT Filed: Jan. 5, 1998

[86] PCT No.: PCT/FR98/00004

§ 371 Date: Mar. 24, 1999

§ 102(e) Date: Mar. 24, 1999

[87] PCT Pub. No.: WO98/30125

PCT Pub. Date: Jul. 16, 1998

[30] Foreign Application Priority Data

Jan. 6, 1997 [FR] France ..... 97 00224

[51] Int. Cl.[7] ..... A45D 26/00

[52] U.S. Cl. ..... 606/133

[58] Field of Search ..... 606/133, 131; 452/83, 90

[56] References Cited

U.S. PATENT DOCUMENTS

| | | | |
|---|---|---|---|
| 4,960,422 | 10/1990 | Demeester | 606/135 |
| 5,041,123 | 8/1991 | Oliveau et al. | 606/133 |
| 5,084,055 | 1/1992 | Demeester | 606/133 |
| 5,196,021 | 3/1993 | Kabla | 606/133 |
| 5,207,689 | 5/1993 | Demeester | 606/133 |
| 5,281,233 | 1/1994 | Dolev | 606/133 |
| 5,494,485 | 2/1996 | Gabion et al. | 606/131 |
| 5,507,753 | 4/1996 | Iwasaki et al. | 606/133 |
| 5,611,804 | 3/1997 | Heintke | 606/133 |

FOREIGN PATENT DOCUMENTS

| | | |
|---|---|---|
| 147 285 | 7/1985 | European Pat. Off. . |
| 2 662 338 | 11/1991 | France . |
| 2 675 354 | 10/1992 | France . |
| WO 92 15223 | 9/1992 | WIPO . |

*Primary Examiner*—Paul J. Hirsch
*Attorney, Agent, or Firm*—Pillsbury Madison & Sutro

[57] ABSTRACT

A depilatory device having a manually grippable casing and enclosing a motor for driving a rotary roller (1) around a central shaft (10) disposed behind a window provided in the casing. The roller has one or several rows of tweezers, each row being formed by a first series of side-by-side, parallel movable blades (20) interposed with a second series of fixed disks or equally movable blades (40), as well as control elements (56–85) for moving the movable blades in translation in the longitudinal direction of the shaft so as to press them against the others in order to grasp the hairs to be extracted, then separate them. The blades (20, 40) of at least one series are cross-shaped, one pair of opposite arms (23) being at least partly curved in one longitudinal direction, the other orthogonal pair of opposite arms (23') being at least partly curved in the other direction, these blades being held by their respective support (10, 30) in their base (21, 41) at the junction point of the arms.

11 Claims, 6 Drawing Sheets

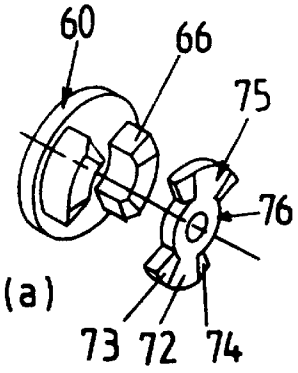
FIGURE 4
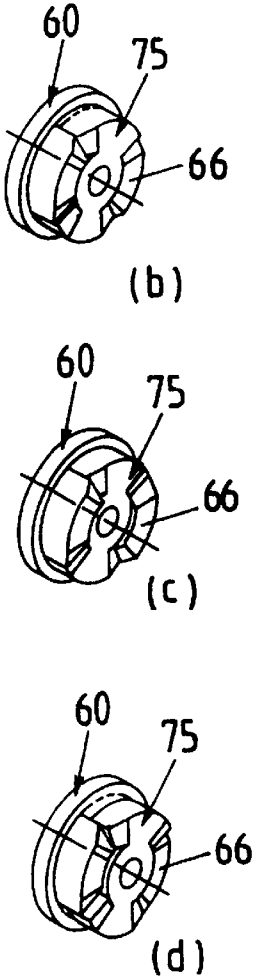
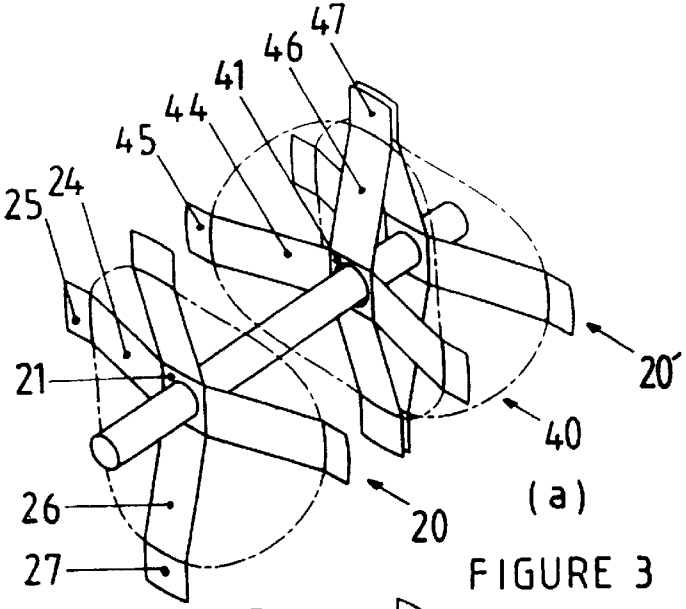
FIGURE 3
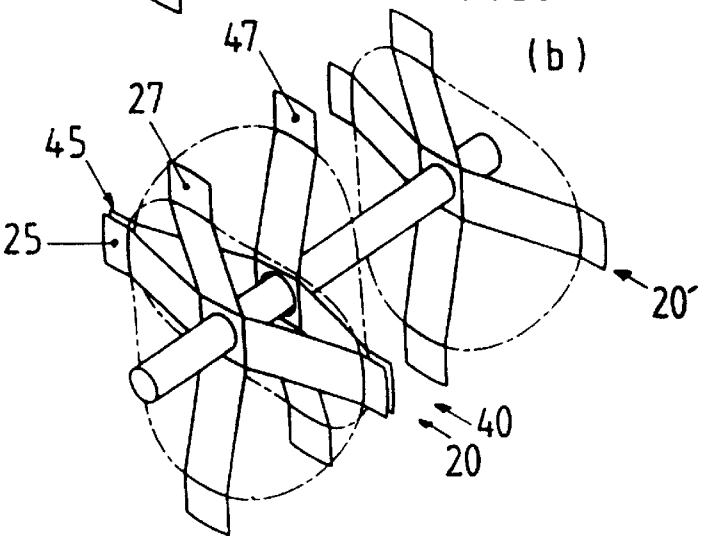

56'
70'
84
56
70
30
20
25
45
40
47
27
- 10 -
75'
66'
84
75
66

70'
56
27
47
- 10 -
66'
84
75

70'
S
84
20
25
45
40
47
27
66'
S

70'
S
20
25
45
40
66'
S 84
70'
20
25
45
40
66'
84
- 10 -
30

DEPILATORY DEVICE WITH ROTARY ROLLER

This application is the national phase of international application PCT/FR98/00004 filed Jan. 5, 1998 which designated the U.S.

TECHNICAL FIELD

The present invention relates to a hand-held depilatory device intended to remove hair from the human body considered to be superfluous for aesthetic or other reasons.

PRIOR ART

A known family of depilatory devices is based on a roller rotating around a central axis disposed behind a window in one end of the casing, this roller comprising one or several rows of tweezers, each row being formed by a first series of side-by-side, parallel movable blades interposed with a second series of fixed disks or equally movable blades, a tweezer being constituted by a blade of the first series associated with the adjacent disk or blade of the second series. It is also provided with control means for successively bringing the blades to press against one another so as to grasp the hairs to be extracted, then separating them to allow the extracted hairs to be removed before the next hairs are inserted between the blades.

In order to be effective, a depilatory device must simultaneously comply with a plurality of constraints. First of all, the row of tweezers or two adjacent rows must be able to treat the entire area defined by the window. Secondly, the closure of the tweezers must occur as quickly as possible, at the precise moment at which they pass over the base of the hair at the level of the skin, especially when the grasping zone is not very large. Thirdly, the value of the grasping pressure must be set at a value that is neither too high, in which case the hair is merely cut, nor too low, in which case the hair slides through without being extracted. Fourth, the above-mentioned characteristics must exist simultaneously, and in homogeneous fashion, in each of the tweezers forming a row. Lastly, the control mechanism must be as simple as possible in order to be reliable over time and inexpensive.

A first type of depilatory device in this family, the so-called "pivoting blade" type, described in the document EP 328 426 (Demmester/Braun), comprises a rotary roller formed by a series of circular blades disposed side by side, each blade having two diametrically opposed protuberant grasping zones. These blades are mounted through a central opening onto the shaft of the roller so as to be pivotable on an axis perpendicular to this shaft. Two bars (or rods) slide-mounted parallel to and against the shaft comprise transverse slots, into each of which is inserted an edge of the central opening of a blade, these blades being alternately coupled with one of these bars and with the other. Each bar is driven by a cam in opposition to a small return spring so as to ensure, two times per turn of the roller, the simultaneous rotation of these blades, one in one direction and the next in an opposite direction so as to come into contact with one another like tweezers.

The device according to the document EP 403 315 (SEB) is similar except for the fact that the tweezers are each formed by a pivoting half-blade belonging to a first series in association with a fixed disk belonging to a second series, a single control bar being sufficient to actuate the tweezers of a row. Each half-blade is mounted so as to pivot around its own base held inside a slot of the hub, this pivoting being imparted by the slot of the bar engaged with the lower edge of the opening of the half-blade through which the bar passes.

In both of these devices, only two rows of tweezers per roller are normally provided, all the tweezers in a row being active simultaneously when they pass in front of the window of the casing.

Moreover, the correct return of the blades to the separated position is dependent on springs that must be rigid enough to drive all of the blades, which exerts a detrimental level of stress on the motor, but small enough to be housed discretely.

The first variant of a depilatory device described in the document FR 2 662 338 (Matsushita) comprises a roller composed of fixed disks and laterally movable blades. These disks and blades, having a square central opening, are alternately threaded onto a rotary central drive shaft, also of square cross section. The circular fixed disks are kept equidistant by spacers, and have four openings disposed crosswise for the passage of control rods located near the central shaft. The movable blades are substantially cross-shaped, and their central opening is also cross-shaped except for the center, which is enlarged into a square in order to be rotatably threaded onto the spacers. Two control rods diametrically opposed to the shaft are engaged with a first series of movable blades so that, by moving in the opposite direction, they impart a pivoting motion; the two other rods positioned at 90° pass freely, but are engaged with the second series. Each rod holds on its end a wheel engaged in a helical groove of a fixed end bearing acting as a cam, this groove alone imparting the back and forth motion without the aid of a spring. The movable blades then pivot so as to come into alternating contact with their two adjacent disks.

This device, with its substantially cross-shaped blades, has four rows of tweezers around the roller; however, every other tweezer is inactive during the passage of a row in front of the window. This means that half of the hair is extracted one quarter turn later, which dissipates and reduces the pain.

On the other hand, the control mechanism with four control rods and two cams with helical grooves is particularly complex, and therefore has doubtful reliability over time and a non-negligible production and assembly cost. Among other things, the wheel is led to change its direction of rotation cyclically when it reaches an alternate slope of the helical groove during the passage from a "forward" to a "backward" motion, or vice versa. These abrupt changes in the direction of rotation entail stress, and therefore rapid wear on the wheel.

The basic principle of these pivoting blade depilatory devices is that the lever arm with which the control bars act on the tweezing blades is relatively small, so that with a relatively short bar stroke, it is possible to obtain a maximum separation of the tweezer blades, thus facilitating the insertion of the hairs between these blades. Moreover, for a given tweezer opening, the bar stroke is twice as short in the first device, in which all of the blades are movable, than it is in the last two devices described. The closure speed is particularly fast since the lever effect is greater, making the cam less deep. However, the slightest alteration in the shape of the cam, for example due to dulling, can cause a detrimental delay in the moment of closure.

On the other hand, the value of the grasping force at the level of the tweezing zone, which is a submultiple of the force applied to the bar by the cam, in addition to the uniformity along the row, is determined by the final positions of numerous parts that are substantially rigid. Therefore, the slightest error in the dimensions of one of them, whether in the shape of the cam, the distribution of the slots on the bars, or the length of the blades, either from the start during the production of these parts, or as a result of wear, negatively affects this effective grasping value to a substantial degree.

Above all, given that the various grasping elements pivot at the level of the central axis of the rotating cylinder, they form a relatively wide angle in their grasping position, in such a way that the edges pressing against one another frequently only succeed in cutting the hairs, rather than pulling them out.

A second type of depilatory device in this family, the so-called "translating blade" type, is described as a variant in the document EP 147 285 (Alazet). This depilatory device comprises a first series of fixed parallel disks on a hub driven in rotation by an electric motor, and a second series of straight blades disposed between the disks and integral with a rod which holds them like a comb. The rod is axially displaced by a cam acting on one of its ends, in opposition to a return spring acting on its other end. Thus, these blades move together in translation, parallel to one another, and in principle come into contact with the disks simultaneously so as to produce a grasping effect.

However, the proper engagement of the hairs in these tweezers and the uniformity of the grasping force from one tweezer to another also highly depends on the precision of two elements: the stacking of the disks and of the blades of the comb, whose intervals must be absolutely equal to one another. This drawback affects the cost and the effectiveness of this device. Moreover, only two rows of diametrically opposed tweezers are provided on the roller, all of the tweezers being active when the row passes behind the window of the casing.

The document WO 92/15223 (Dolev) describes another translating blade depilatory device in which the rotary roller on a central shaft comprises a series of flat disks, fixed in the longitudinal direction, and interposed movable flat blades, which between them define the tweezers. The disks have tenons on one side and openings on the other side so that they fit together when stacked so as to constitute the roller, which is driven in rotation by a collar disposed on one of the end flanges. The movable circular blades have openings which correspond to the tenons so that they can be disposed between the fixed disks, while being longitudinally movable relative to the roller. The central openings of these movable disks have radial tenons facing the inside, which are inserted and locked into transverse slots disposed at regular intervals on the rotary shaft.

The end of the central shaft inside the casing is itself integral with a gear wheel meshed with a substantially larger pinion. The inner surface of this gear wheel is extended by a cylindrical block, into whose periphery a sinusoidal groove has been cut. Small wheels integral with the casing are engaged in this groove. Thus, during the rotation of the shaft, the action of the wheels in the cam groove causes an alternating forward and backward movement of this shaft in addition to its rotation, which pushes the movable blades against, and pulls them away from, their adjacent fixed disks. The alternating movements of the shaft therefore cause an opening and a closing of the tweezers, trapping the hairs in these spaces when open and extracting them when closed.

In a variant, the longitudinally fixed rotary roller is formed by a tube with cross-shaped cross-section, into whose branches grooves have been cut at regular intervals. Cross-shaped blades are locked onto the translationally movable central shaft so that the branches of the blades extending into the grooves pinch the hairs against the edges of the grooves.

However, the springless direct cam control device, which must ensure a long forward/backward movement of each blade from one of its adjacent disks to the other, is particularly bulky and complex, therefore costly. Moreover, as mentioned above, a wheel running along a sinusoidal groove is cyclically caused to change directions abruptly, which is detrimental to its longevity.

One advantage of these translating blade depilatory devices is that it is easier to create flat tweezing zones which distribute the grasping force at a pressure which is better for grasping the hair in order to pull it out.

However, once again the depilatory effectiveness of this device, both in terms of the setting of the grasping value and the uniformity of the grasping action of each of the tweezers, depends on the precision of the intervals between disks and between blades, which must be absolutely equal, a compensatory blade flexibility having little effect in the case of a plane-to-plane contact. In the variant, it is suggested that the groove edge be made oblique in order to allow a certain play based on the flexibility of the blades. However, this oblique edge acts rather like a knife.

SUMMARY OF THE INVENTION

The object of the present invention is to provide a rotary drum depilatory device comprising tweezers formed of movable blades associated either with other movable blades or with fixed disks, which offers a better compromise between the various constraints to be complied with so as to obtain an optimal removal of the hairs to be extracted.

As much as possible, a row of tweezers, or two rows that are adjacent, that is, appearing successively in the window of the casing at short intervals, for example less than a third of the rotation of the roller, must be able to treat practically the entire area of the skin appearing in front of the window of the casing through the effective closure, at the appropriate moment, of all the tweezers in a row.

A device of this type must specifically ensure a relatively constant grasping pressure value without requiring a system for setting the grasping force during assembly, which is always a costly operation, or a system for control by the user, with an external control, which constitutes an overly random solution.

The control mechanism must be able to adjust to the inevitable play between parts that is necessary to their proper operation, while remaining relatively simple in design, in order to increase reliability and reduce production costs.

These objects are achieved by means of a depilatory device comprising a casing provided for hand holding and enclosing a motor for driving a rotary roller around a central shaft disposed behind a window provided in a casing, this roller comprising one or several rows of tweezers, each row being formed by a first series of side-by-side, parallel movable blades interposed with a second series of fixed disks or equally movable blades (each tweezer thus being constituted by a blade of the first series associated with the adjacent disk or blade of the second series), as well as control means for moving the movable blades in translation in the longitudinal direction of the shaft, so as to press them against the others in order to grasp the hairs to be extracted, then separate them, due to the fact that the blades of at least one series are cross-shaped, one pair of opposite arms being at least partly curved in one longitudinal direction, the other orthogonal pair of opposite arms being at least partly curved in the other direction, these blades being held by their respective support in their base at the junction point of the arms.

Thus, through the combination of a translational movement of the active blades from their base, and cross-shaped blades, a flectional elasticity of the blade arms is brought into play in an intentional and controlled way. In effect, the elasticity of an arm can be correctly established by choosing a metal with a given coefficient of elasticity, and by determining appropriate values for the normally flat rectangular cross-section of the blade, and for its rectilinear height between its mounting base and its grasping periphery. Moreover, this elasticity can be adjusted by providing an opening in the arm of the blade, which locally modifies the cross-section, and therefore its elasticity.

Depending on the technique used to produce the blades, including cutting and drawing or die stamping, the curvature of a blade can be distributed evenly along the entire height of its arms, or this curvature can be formed in only part of them, for example either at the level of their mounting base or just below the curvature delimiting their end grasping zone.

Thus, an elastic element with a correctly predetermined coefficient is interposed into the kinematics in operation from the cam wheel to the grasping zone, making it possible to establish, for a theoretical longitudinal translational displacement value, an exact grasping force value, but more importantly to establish, for an inevitable error range of this displacement, a grasping force range which at minimum prevents the hair from sliding and at maximum is always less than a critical value at which the hair would be cut. Because of this intermediate elastic part, the grasping force can therefore be better controlled in terms of maximum and minimum for a predictable maximum play of kinematics, thus making it possible to eliminate to a large extent the drawback of a need for precision machining of the parts, which has repercussions in terms of production capacities and costs.

Moreover, this elasticity, used to establish the grasping force, can simultaneously be used to advantageously return the kinematics in the backward direction after a forward displacement imposed simply by a set of cams. In other words, the bulky spring used previously to operate a cam control device is in this case distributed along the row of blades, each blade contributing the equivalent of the work provided by one spire of a spring. This spring effect distributed along the row of blades is therefore very reliable while being discrete.

In the case of a series of movable blades associated with fixed disks, the control means can simply be comprised of either one cam on each end of the element supporting the blades, for the forward movement toward the first adjacent disk and for the backward movement toward the other adjacent disk, respectively, or a double-acting cam disposed on only one side of the support element.

Preferably, the projection of the arm curvature onto the shaft is between one-third and two-thirds, preferably half, of the value of the longitudinal translational displacement of their support.

In combination with the cross-shaped blades, which make it possible to treat the entire area of the skin appearing in front of the window using two successive rows of tweezers offset by only a quarter turn, the curvature of the arm makes it possible to intentionally establish the portion of displacement dedicated to the opening of the tweezers for the insertion of the hairs, and the portion of displacement, substantially greater than before, dedicated to the use of the elastic part of the blade arms for applying the desired range of grasping force.

Preferably, the two series are composed of curved blades, the blades of one series being curved in the opposite direction from the other.

Uncertainties in the establishment of the coefficient of elasticity of each of the flexible arms can therefore be compensated in order to obtain a grasping value that is more uniform along the row.

In the case of two series of movable blades, it is advantageously possible to provide simple cam-and-wheel control devices with for each of the supporting elements, but with a depth that is only half of the inter-blade displacement, thus substantially increasing their service life.

Preferably, the peripheral zone of the blades constituting the grasping zone is at an angle between 1 and 15 degrees relative to the plane perpendicular to the shaft. Thus, this peripheral grasping zone is therefore delimited at the end of the arm by a fold.

Then, under the stress of the predetermined grasping force, these zones practically return to the plane perpendicular to the shaft, so as to grasp the hairs not only at one point, but advantageously along a line of contact, or even a plane of contact.

Advantageously, the periphery of the blades constituting the grasping zone has a width greater than that of the arm that carries it.

Given that the width of the arm is preferably limited in order to give this arm a certain rectilinear height necessary for predictable flexion from its base at the junction point, the enlarged end grasping zone makes it possible to compensate for potential shifts at the moment of closure relative to the base of the hairs at the level of the skin.

According to another aspect of the invention, the depilatory device comprising a casing provided for hand holding and enclosing a motor for driving a rotary roller around a central shaft disposed behind a window provided in a casing, this roller comprising one or several rows of tweezers, each row being formed by a first series of side-by-side, parallel movable blades interposed with a second series of fixed disks or equally movable blades (each tweezer thus being constituted by a blade of the first series associated with the adjacent disk or blade of the second series), the peripheral grasping zones of the blades being offset in the axial direction relative to the bases of the blades, as well as control means for moving the movable blades in translation in the longitudinal direction of the shaft so as to press them against the others in order to grasp the hairs to be extracted, then separate them, is noteworthy due to the fact that the first series of blades is integral with a central sliding shaft, the other series of blades is integral with a cage surrounding the sliding shaft coaxially, the control means applying alternating translational movements to the sliding shaft and to the cage, respectively, in opposite directions.

Thus, a normally long translational stroke is divided into two half-strokes carried out reciprocally by the sliding shaft and the cage, which makes it possible to provide for each of these parts a control device with a cam that is less deep, and therefore more reliable over time.

Preferably, the sliding shaft is a sleeve surrounding the shaft of the roller, or the shaft of the roller itself, on the outer periphery of which slots are provided for holding the base of the blades.

Preferably, the cage is composed of a plurality of axial rods, both of whose ends are attached at regular intervals to the periphery of two lateral flanges bordering the roller, the radially internal surface of the rods having slots for holding the base of the blades.

In the case where cross-shaped blades are used, a structure of this type with only four rods is composed of parts that are simple to produce and easy to assemble. In particular, it is possible to provide a relatively large shaft, for example with a diameter about one third that of the roller, and thick rods running between the crossed arms, for example equivalent to the rectilinear height of the crossed arms, which assembly makes it possible to firmly hold the bases of the blades equidistant from one another.

Advantageously, the control means applying alternating translational movements to the sliding shaft and the cage, respectively, in opposite directions, comprise

- a first pair of cams in diametrically opposed sectors of a circle integral with the external surface of at least one of the flanges of the cage,
- and interposed with the first pair, a second pair of cams in diametrically opposed sectors of a circle integral with the end of the sliding shaft,
- which cams act counter to a diametrical pair of wheels mounted on the casing facing the flange,
- as well as elastic return means acting on the cage and on the sliding shaft.

Thus, when one pair of cams is driven inward by the wheels, the other pair is free to move out again under the effect of the return means, thus smoothly performing an alternating, reciprocal double movement. As a result of this disposition, two distinct blade supporting elements, namely a sliding shaft and a cage, are successively driven by a control device wherein the thickness of the volume is not much larger than the cam depth relative to the amplitude of the displacement.

Preferably, the blades are cross-shaped, with one pair of opposite arms curved in one longitudinal direction and the other pair of arms curved in the other direction, the blades of one series being curved in the opposite direction from the other. The other flange and the other end of the sliding shaft, respectively, have a pair of cams in the form of sectors of a circle, which pairs are interposed with one another and offset by a quarter turn relative to the cams of the first flange.

Since the blades themselves ensure the elastic return function in one direction and then the other, it is possible to provide two sets of cams offset by a quarter turn on either end of the roller, but with smaller cam depths, thus increasing their longevity. A so-called "neutral" position appears when the wheels are located right between two cams, which in this case are flush with the same plane, the grasping zones of the blades in this position being equidistant, or even touching. On the other hand, the reciprocal action of the wheels on a pair of cams on each side of the roller, respectively acting on the sliding shaft and on the cage or vice versa, makes it possible to intentionally apply the displacement in a so-called "forward" direction so as to positively close the series of momentarily extracting tweezers located in the second half of the window, which it is about to leave, and simultaneously to effectively open the other, adjacent series of momentarily collecting tweezers arriving in the first half of the window. The return to the transitory neutral position is essentially ensured automatically by the elastic load accumulated in each arm of the closed blades.

In particular, this symmetrical control device makes it possible to dispose the window in the middle of one end of the casing, which can therefore have a sensibly parallelepipedic shape with rounded corners, similar to electric razors, and comfortable to hold in the hand.

Above all, this device for controlling complex movements, which also ensures the forward and backward movements of double rows of blades, is actually embodied by a relatively simple, play-tolerant mechanism comprising a limited number of easy-to-produce parts.

BRIEF DESCRIPTION OF THE DRAWINGS

The invention will be better understood through the study of a non-limiting embodiment illustrated in the appended figures, in which:

FIGS. 4*a*, 4*b*, 4*c* and 4*d* illustrate views in perspective of the crossed cams along the angle of view IV in FIG. 2, in the disassembled, neutral, "sliding shaft forward," and "cage forward" positions, respectively, and FIGS. 5*a*–5*h* schematically illustrate a first mode of operation of the depilatory device during a rotation of the roller by one half-turn, FIGS. 6*a*–6*e* schematically illustrate a second mode of operation of the depilatory device during a rotation of the roller by one quarter-turn.

PREFERRED EMBODIMENT OF THE INVENTION

Figure 1:
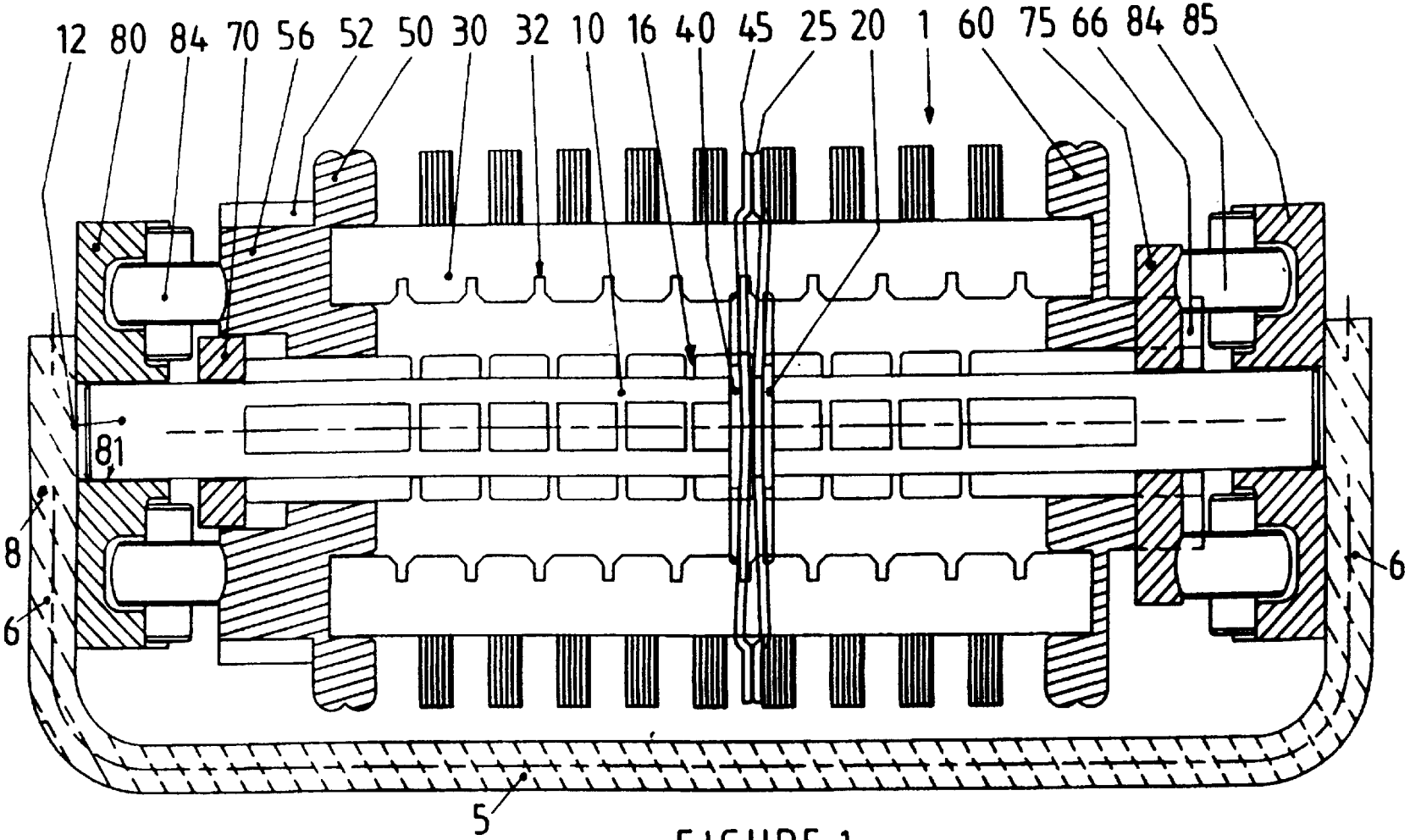
FIG. 1 is a view in longitudinal section of a depilatory device according to the invention.
Figure 2:
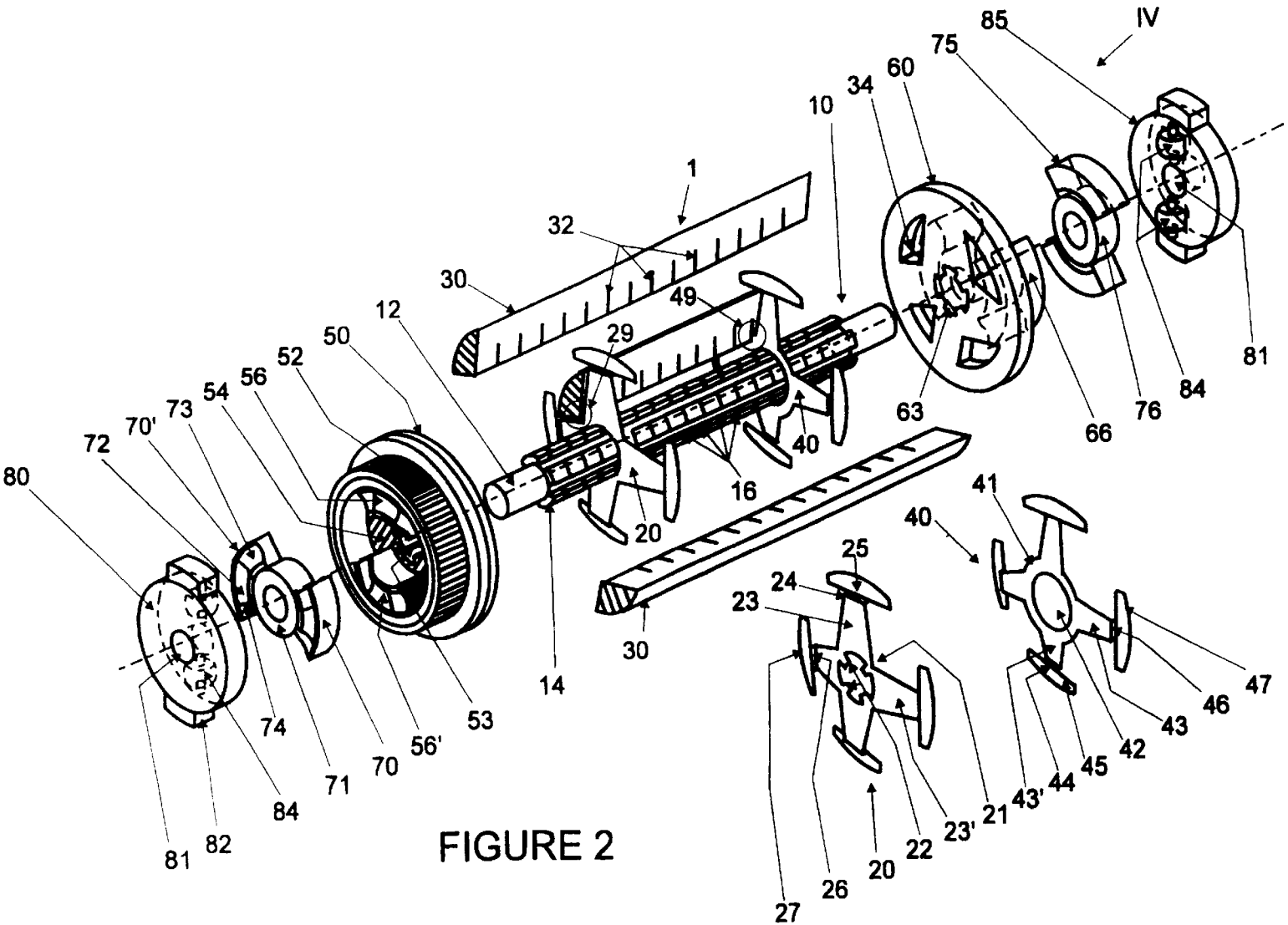
FIG. 2 is an exploded view in perspective of the main parts composing the depilatory device according to FIG. 1, FIGS. 3*a* and 3*b* are schematic views in perspective of the position of a blade relative to its two adjacent blades, respectively in a first angular position and in a second angular position offset by a quarter turn.

FIGS. 1 and 2 illustrate a depilating head comprising a rotary drum 1 composed of a central shaft 10 rotating in a cradle 5 and a cage mounted coaxially on the shaft it surrounds, this cage being formed by two lateral flanges 50, 60 which hold between them four rods 30.

In the exemplary embodiment described, the left flange 50 has a lateral gear wheel 52 driven by a reducing gear passing through an opening provided in the large bottom crossbar of the cradle 5 and driven in rotation by an electric motor enclosed in the casing.

The cage driven in this way by its left flange is also engaged via the notched central openings 53, 63 of its flanges with a longitudinal toothing 14 of the shaft 10. The two smooth ends 12 are supported in openings 81 provided in non-rotary bearing disks disposed on each end against each of the lateral arms 6 of the cradle 5.

A first series of cross-shaped blades 20 are mounted in parallel, side-by-side, at regular intervals along the shaft 10. For this purpose, the teeth 14 have equidistant circular slots 16. Correspondingly, the base 21 at the junction point of the blades 20 has an opening with a diameter identical to that of the crests of the teeth 14, and four radial tenons 22 oriented inward, with an internal diameter identical to that of the foot of the longitudinal toothing 14. The mounting of a blade 20 onto the shaft 10 therefore consists of inserting the tenons 22 into the longitudinal inter-tooth spaces to bring the blade into its longitudinal position then, by rotating it by one quarter turn, locking each tenon 22 into its corresponding slot 16 on the shaft. The blade 20 is then longitudinally integral with this shaft.

A second series of cross-shaped blades 40 interposed with the first one is itself held by the cage, specifically by slots 32 provided on the internal radial surface of the axial rods 30. For this reason, the base 41 at the junction point of these blades 40 is in the shape of a circular collar having a central opening 42 with a diameter greater than that of the crests of the longitudinal teeth 14. Thus, each blade 40 of the second series is threaded onto the shaft 14 after each blade 20 of the first series, these blades 40 temporarily resting freely on the teeth 14 between two slots. Once the second series has been threaded and the first has been locked into these slots, it is then possible to install the axial rods 30 so that the slots 32 are locked, respectively, onto each of the circular bases 41 at the junction points of the blades 40 of the second series, as illustrated in 49, the angular bases 21 at the junction points of the blades 20 of the first series leaving a free passage for the rods 30 as illustrated in 29 in FIG. 2.

In addition, the inner surfaces of the flanges 50 and 60, respectively, have four seats 34 for the ends of rods 30. Thus, once both series of integrated blades 20, 40 have been placed on the shaft 10, and after the installation of the axial rods 30, the flanges 50 and 60 are mounted on either end of the shaft 10 in such a way that, simultaneously, their notched openings 53, 63 are engaged with the longitudinal teeth 14 and the ends of the axial rods 30 are inserted into their corresponding seats 34 in the flanges.

More specifically, according to the invention, the shaft 10 holding the first series of cross-shaped blades 20 and the cage 30/50/60 holding the second series of blades 40 are axially movable in opposite directions from one another, in addition to their common rotary movement within the cradle 5.

For this purpose, a device comprised of identical, crosswise nesting cams is provided on each external surface of the flange 50, 60, but one device 56/70 is offset from the other one 66/75 by a quarter turn, and located opposite each crossed cam device is a pair of wheels 84, diametrically opposed relative to the shaft 10 and respectively installed in a right wheelbearing disk 85 and a left wheel-bearing disk 80 disposed at the end of the roller against the corresponding arm 6 of the cradle 5.

More precisely, as is more clearly visible in the drawings of FIG. 4, the flange 60 comprises, in one piece on its external surface, two diametrically opposed cams 66, 66' in the form of a segment of a circular collar corresponding to a sector of a circle with an angle at the vertex on the order of 90°, the central recess corresponding to the notched opening 63 for the passage of the sliding shaft 10. Installed between these two female cams 66 of the flange 60 is a male cam 75 composed of a central collar 76 supported against the teeth 14 of the sliding shaft 10, this central collar being surmounted by a pair of diametrically opposed male cams 75, 75', each in the form of a segment of a circular collar with an angle at the vertex on the order of 90°.

The angular position of the cams relative to the cage determines the position of closure of a row of tweezers relative to its median line. This closure can thus be triggered either when this median line appears in the middle of the window, or ahead of or behind it. It is also possible for one row of tweezers to remain closed longer than the other, the angle at the vertex of one pair of opposite cams, male or female, being greater than 90°, for example 120°, the angle at the center of the other pair of opposite cams being correspondingly reduced, for example to 60°. In the extreme, it is possible to provide eight rows of tweezers, the cams in this case being cross-shaped and having sectors with an angle at the vertex on the order of 45°, and offset equally by 45° relative to one another.

This crossed cam device is practically identical on the left flange 50, except for the fact that the left pair of female cams 56, 56' is integrated with the inside of the driving gear wheel 52 by providing an inner flange wall 54 in the center of which is the notched opening 53 through which the teeth 14 of the sliding shaft 10 pass. These female cams 56 therefore leave, inside the gear wheel 52, a seat for a left male cam, also formed by a central collar 71 supported against the teeth 14 of the sliding shaft 10, this collar being surmounted by two diametrically opposed male cams 70, 70' in the form of a circular collar with an angle at the vertex on the order of 90°.

As is more clearly visible in FIGS. 2 and 4, each cam in the form of a circular collar, whether male or female, has a first ascending ramp 73 followed by a flat surface 72 and ends in a descending ramp 74. In particular, this descending ramp can be steeper than the ascending ramp, this descending ramp for example corresponding to a sector of a circle with an angle at the vertex on the order of 20° for an ascending ramp corresponding to a sector of a circle with an angle at the vertex on the order of 30°, the flat surface in this case corresponding to a sector of a circle with an angle at the vertex on the order of 40°. According to another version, the ascending ramp can correspond to a sector of a circle with an angle at the vertex on the order of 25° to 35°, particularly 30°, the flat surface can correspond to a sector of a circle with an angle at the vertex between 50° and 60°, particularly 55°, the descending ramp in this case being very small, for example a sector of a circle with an angle at the vertex of less than 5°. The height difference of the flat surface relative to the beginning of the ascending ramp determines the displacement imposed by this cam to its corresponding part, and is between 0.4 and 1.2 mm.

As is more clearly visible in FIG. 1, the male cams 70, 75 are mounted on the smooth end parts 12 of the sliding shaft 10, which ends move inside openings/bearings 81 of the disks 80, 85 bearing the wheels 84, these disks being kept from rotating by the cradle, for example by the locking action of locking tenons 82 of the disks 80, 85. Since the male cams and the shaft are all driven at the same speed by the flanges, these parts are therefore fixed in rotation relative to one another.

The two pairs of wheels 84 being horizontal, that is approximately parallel to the bottom crossbar of the cradle 5 (or vertical as illustrated in FIGS. 1 and 2), and the left and right crossed cam devices being offset relative to one another by a quarter turn, when one of the pairs of wheels acts on a male cam to push the sliding shaft in one direction, the other, opposite pair of wheels acts on a female cam, pushing the cage in the opposite direction, this situation being reversed one quarter turn later, thus creating an alternating reciprocal double movement of the sliding shaft 10 relative to the cage 30/50/60.

FIG. 4*c* illustrates in perspective the situation of the crossed cams 66, 75 of the right part of FIG. 1, a situation in which the male cam 75 is nested inside the female cam 66, the sliding shaft being pushed all the way to the left and the cage all the way to the right. FIG. 4*d* illustrates the corresponding situation of the cams in the left part of this FIG. 1. FIG. 4*b* illustrates a transitory neutral situation in which the cams 66 and 75 are flush with the same plane, the cage in this case being centered relative to the sliding shaft 10. These back-and-forth movements between sliding shaft and cage bring each cross-shaped blade 20 of the sliding shaft successively into contact with the two adjacent cross-shaped cage blades 40.

According to another, no less important aspect of the invention, the cross-shaped blades 20, 40 of the two series are not flat at all, but doubly curved in opposite directions.

As is more clearly visible in FIG. 3*a* and in the lower right part of FIG. 2, the blades 20 of the first series belonging to the sliding shaft 10 have one pair of opposite arms 23 curved in a first direction 24, causing the peripheral grasping zone 25 to be brought closer to a peripheral grasping zone 45 of the adjacent blade 40 of the second series integral with the cage, whose corresponding arms 43' have an equal curvature 44 oriented in the opposite, that is facing, direction. In contrast, the other pair of arms 23' of the blade 20, at right angles from the first arms 23, has curvatures 26 in the opposite direction, moving the corresponding grasping zones 27 away. The same is true for the other orthogonal pair of opposite arms 43 of the blade 40, whose curvatures 46 also move the corresponding grasping zones 47 away, bringing it closer to the opposing grasping zones of the next cross-shaped blade of the sliding shaft.

In other words, the plane orthogonal to the sliding shaft 10 passing through the grasping zones 25 and the orthogonal plane passing through the grasping zones 27 offset by a quarter turn are located on either side of, and equidistant from, the plane of the base 21 at the junction point of the blade on its support. The same is true for the two orthogonal planes passing through the grasping zones 45 and 47, respectively, located on either side of the base 41 at the junction point of the blade 40.

One pair of arms of a blade is therefore curved in the direction of the corresponding pair of blades of the adjacent blade with which it will come into contact during the movement of the sliding shaft 10 in a given direction relative to the cage 30/50/60. The inverted curvature of the orthogonal arms corresponds to the movement in the opposite direction of the sliding shaft relative to the cage one quarter turn later, as clearly illustrated in FIG. 3.

It is important to note that the curvature of each blade arm can be evenly distributed along the entire height of the arm, which is therefore arched, or can be concentrated in a fold at the level of the base at the junction point, a second fold delimiting the peripheral grasping zone, bringing the latter into a plane substantially perpendicular to the shaft, as illustrated in the drawings of FIG. 3; or it can be concentrated into a double fold in the peripheral grasping zone as illustrated in FIGS. 1 and 2. In the latter two examples, the arms are then substantially rectilinear, whether oblique or perpendicular relative to the shaft.

A first mode of operation of the depilatory device described above will now be explained in further detail, in reference to the schematic FIGS. 5*a* through 5*h*. This mode of operation assumes the presence of a relatively rigid cradle 5 in combination with blade arms curved in such a way that their peripheral grasping zones 25, 45 are practically touching in the neutral position of the cage and sliding shaft, and in combination with cams having substantial descending ramps.

These FIG. 5 drawings schematically illustrate the sliding shaft 10 disposed so as to move in longitudinal translation inside the cage, represented by its axial rods 30. The angularly nesting cams are shown in a line, thus illustrating the order of their arrival in front of the pair of wheels 84, following the arrow (f) of FIG. 5*a*, and also illustrating their angular offset on either side of the same part. More precisely, the sliding shaft 10 is first driven from the left by the first male cam 70, then from the right by the second male cam 75, then again from the left by the third male cam 70' diametrically opposed to the first one, and finally again from the right by the fourth male cam 75' diametrically opposed to the second one 75. Reciprocally, the cage 30 is first driven from the right by the first female cam 66, then from the left by the second female cam 56, then again from the right by the third female cam 66' diametrically opposed to the first one 66, and finally from the left by the fourth female cam 56' diametrically opposed to the second one 56.

The sliding shaft 10 carries a cross-shaped blade 20, a first pair of whose arms is represented in the plane of the figure, these arms being curved toward the right and carrying the grasping zones 25, the second pair of perpendicular arms represented in the middle of the sliding shaft 10 being curved in the opposite direction and carrying the grasping zone 27. The grasping zone 25 faces a grasping zone 45 of an adjacent blade 40 integral with the cage 30, while the grasping zone 27 faces a grasping zone 47 belonging to the other adjacent blade 40 integral with the cage 31.

Figure 5A:
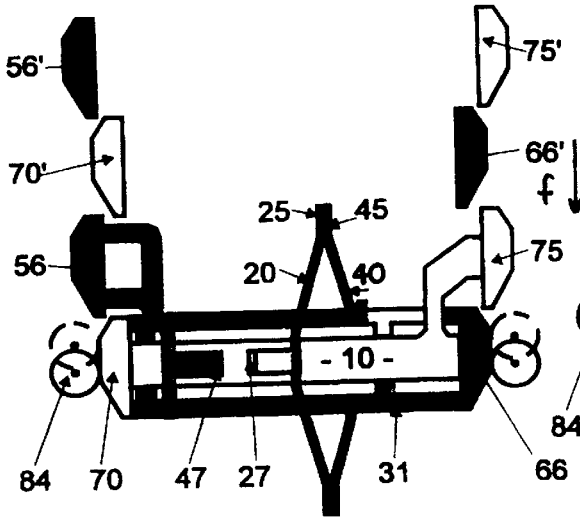

In the starting position at 0° as illustrated in FIG. 5*a*, the wheels 84 keep the sliding shaft 10 and the cage 31 pressed against each other, causing the grasping zones 25 and 45 to be pressed against one another while the grasping zones 27, 47 are largely separated from one another. This situation continues as long as the wheels 84 roll along the flat surfaces of the cams, corresponding to a 25° forward rotation.

Figure 5B:
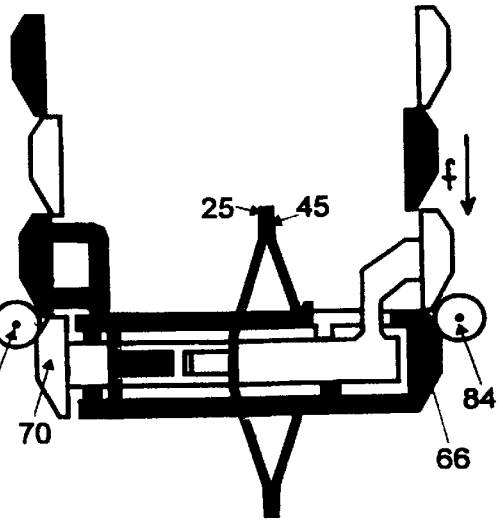

FIG. 5*b* illustrates the situation during the rotation between 25° and 40°, in which the wheels are now located on the descending ramps of the cams 66, 70. Thus, the elastic stresses accumulated in the arms of the zones 25 and 34, acting like the plates of helical springs, begin to separate the sliding shaft and the cage, to the extent allowed by the position of the wheels on the ramps.

Figure 5C:
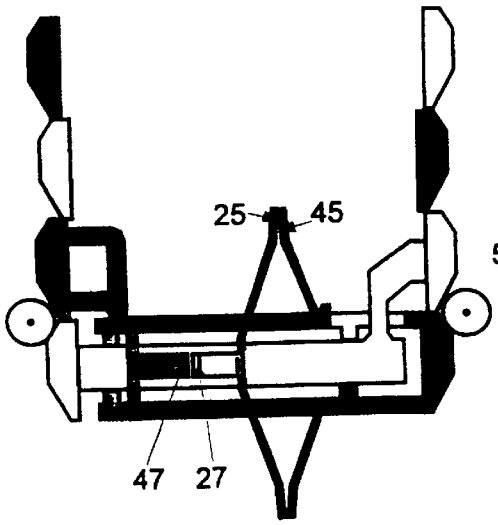

FIG. 5*c* illustrates the situation during the rotation between 40° and 44°, in which the wheels are about to leave the descending ramps of the cams 66, 70. The stresses in the arms of the zones 25, 45 are now weaker, so much so that the zones 25, 45 have returned to an initial inclination. Simultaneously, the two orthogonal grasping zones 27, 47 have moved substantially closer.

Figure 5D:
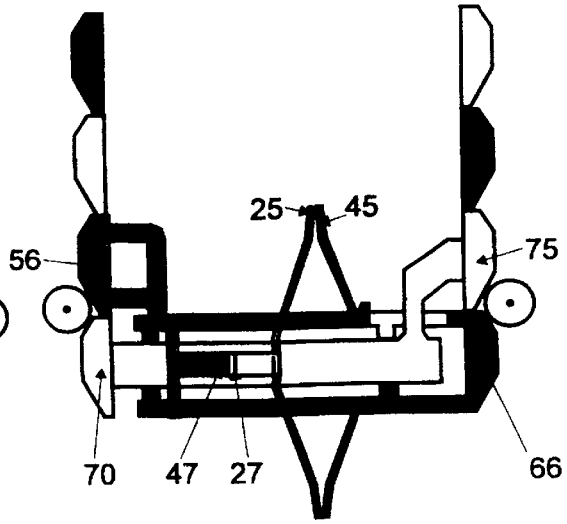

FIG. 5*d* illustrates the situation after the rotation to 45°, in which the sliding shaft has returned to a neutral position relative to the cage and in which, on each side, the cams are again in the same plane. The wheels 84, having left the cams 70, 66, have not yet reached the next cams 56, 75. The grasping zones 25, 45 and 27, 47 are just touching, without exerting any elastic stress. In this situation, no stress is exerted on either the cage or the sliding shaft, and the existence of a slight play between the wheels and the cams may be observed, generally due to a total non-coincidence in the return stroke due to the elastic effect of the cross-shaped blade arms and to the stroke of the cams. This play, which in the best of cases can be null at the start, is generally created later, either as a result of manufacturing tolerances or because of wear, creep or dulling due to operation.

However, the U-shaped supporting cradle 5, chiefly provided to be rigid, like a housing, so as to maintain the strength of an assembly, can nevertheless contain a relative reserve of elasticity. In other words, a slight initial prestressing of this cradle can be applied at just the value necessary to subsequently compensate for the play occurring during this transition.

Figure 5E:
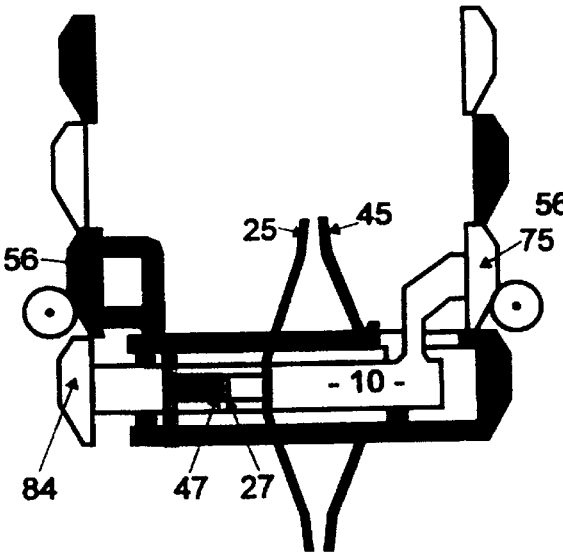

FIG. 5*e* illustrates the situation during the rotation between 45° and 70°, when the wheels 84 act on the ascending ramps of the cams 56, 75. These wheels impose a separation of the sliding shaft 10 relative to the cage 31, which positively stresses the other orthogonal pair of arms corresponding to the grasping zones 27, 47, which arms are now accumulating elastic energy. Simultaneously, the grasping zones 25, 45 begin to open relative to one another.

Figure 5F:
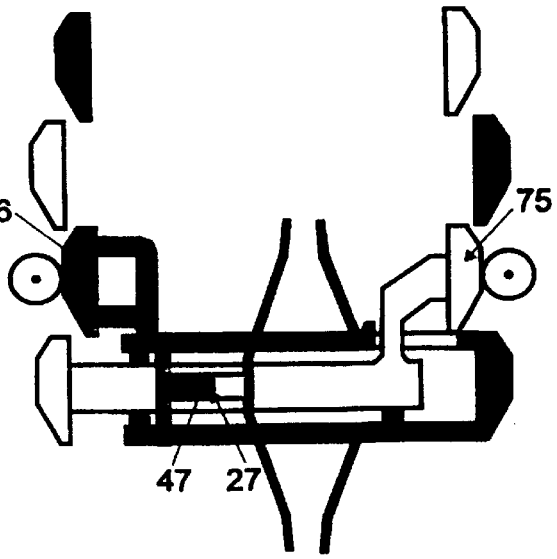

FIG. 5*f* illustrates the situation during the rotation between a 70° and 90° rotation, when the wheels pass over the flat surfaces of the cams 56, 75, causing the sliding shaft to be separated from the cage to the maximum. The grasping zones 27, 47, initially slightly oblique, have now returned to a plane perpendicular to the shaft, effectively grasping the hair along an entire line or plane, which prevents it from being cut.

More specifically, it is noted that at this instant, the grasping force is transformed into a pressure along the line of contact with the hair. Above all, this grasping force is mainly established, according to the invention, by the elastic flexion of the arms corresponding to the zones 27, 47 which develops throughout the displacement phase corresponding to FIG. 5*e*. This intentional, relatively ample flexion causes the resulting grasping force to have at least a minimum, but also a maximum, which are predictable as a function of the inevitable play in the movements but also of the elasticity in the bending of the arms. The coefficient of elasticity in the bending of these arms can be predetermined with relatively good precision by choosing an appropriate elastic material and/or by determining the cross-section and the height of the flexible arm. This elasticity, which comes into play throughout the movement corresponding to the phase of FIG. 5*e,* is radically different from the prior art, in which the rather rigid blades might bend at the end of the stroke, if and only if they were effectively touching the corresponding blade or disk, but being too rigid, at the risk of producing grasping forces resulting in a cutting of the hair.

Figure 5G:
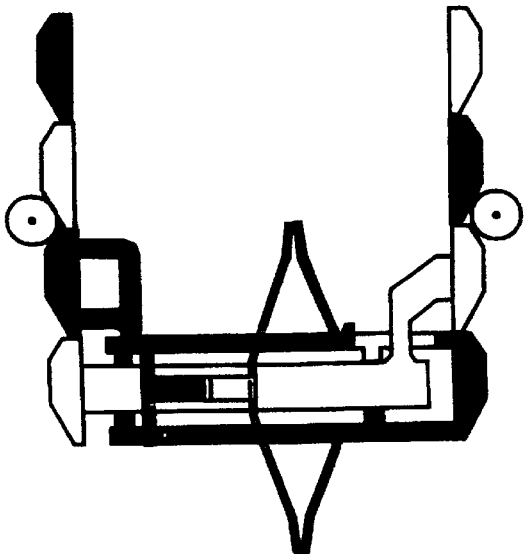
Figure 5H:
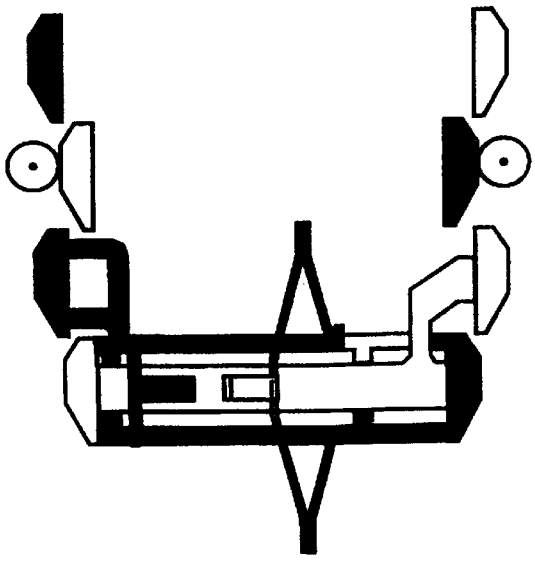

FIG. 5*g* illustrates a return to equilibrium during the passage to a 135° rotation, this situation being substantially identical to the one in FIG. 5*d*. FIG. 5*h* illustrates the situation at a 180° rotation corresponding to a return of the situation in FIG. 5*a*.

A second, alternate mode of operation of the depilatory device will now be described in reference to the schematic FIGS. 6*a* through 6*e*. This mode of operation assumes the presence of a cradle 5 having a relative elasticity based on a prestressing value, for example on the order of 3.5 kg, in combination with blade arms having a shape corresponding to that of FIGS. 1 and 2 and being separated in the neutral position of the cage and sliding shaft, and in combination with cams whose descending ramps are reduced to a minimum. In these drawings of FIG. 6, labels identical to those in FIG. 5 are used to designate similar parts.

Figures 6A, 6B, 6C, 6D, 6E:
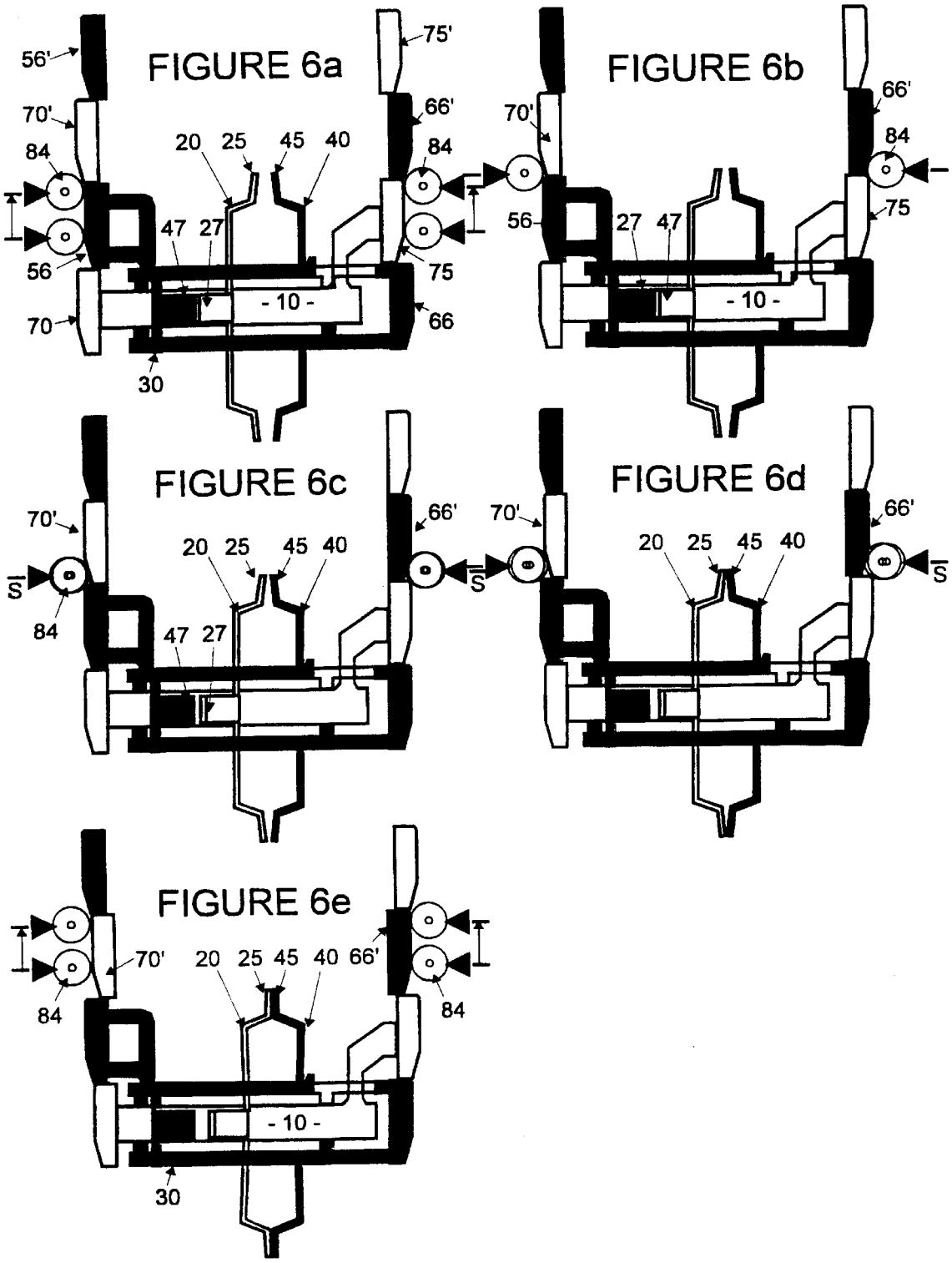

FIG. 6*a* illustrates the situation in which the sliding shaft 10 is maximally separated from the cage 30 by the action of the wheels 84 on the cams 56 and 75, respectively. The grasping zones 27, 47 are pressed against one another, their arms having accumulated elastic energy.

FIG. 6*b* corresponds to the moment where the axles of the wheels 84 have begun to pass the angular downstream edges of the cams 56, 75. It is therefore apparent that these angular downstream edges of the cams 56, 75 follow the arc-of-a-circle peripheries of their corresponding wheel under the pressure separating the spring-blades 27, 47. This movement of the cams 56, 75 causes the next cams 66', 70' to line up in front of the wheels 84 and to not necessarily come into contact with the latter. The return movement of the cams 56, 75 to the neutral position therefore essentially occurs under the impetus of the elastic stress of the releasing blades 27, 47. It may also be seen that the path of the cam has better continuity, which limits noise in case of positional play.

FIGS. 6*c* and 6*d* correspond to an intermediate phase in which the blades 27, 47 are separated, and no longer have an effect, but in which the grasping pressure (S) coming from the elasticity of the cradle, symbolized by the arrows acting on the wheels 84, pushes the latter slightly toward the inside, which in turn push the next cams 66', 70' toward one another until the grasping zones 25, 45 of the next blades 20, 40 come into contact.

FIG. 6*e* corresponds to the grasping position of the blades 20, 40, the sliding shaft 10 and the cage 30 being in the extreme close position, as a result of the ascent of the wheels 84 on the ramps followed by their passage across the flat surfaces of the cams 66', 70'. As may be seen, the ascent of the wheels on the cams has caused a bending of the arms of the blades 20, 40, which are again accumulating elastic energy, the grasping zones 25, 45 being pressed against each other in a grasping plane, as well as a slight deviation of the wheels 84 toward the outside, into the initial position.

This variant mode of operation simultaneously brings into play an elasticity of the blades and an elasticity of the cradle for an operation that is more flexible, therefore more reliable and less noisy.

As is apparent from the reading of this description, the depilatory device according to the invention is essentially composed of parts that are simple to produce, for example by machining for the sliding shaft 10, by cutting for the rods 30 and by casting for the parts 50, 60, 70 and 75. The blades can be cut from metal strips and simultaneously pressed and/or stamped to give them their definitive volumetric shape. Above all, by using the elasticity of the cross-shaped blade arms, and also to a certain extent a pre-stressing of the cradle 5, it is possible to neatly eliminate the problems due to the necessary operational play between the various moving parts.

The depilation is even more effective when two successive rows of grasping zones cover the entire area of the skin appearing in front of the window, through the action of tweezers acting with grasping forces that are substantially homogeneous along the entire row, established within a predetermined range of values. Moreover, the closing of the tweezers takes place through the positive action of wheels on cams of relatively small depth, so that the actions are fast.

A certain number of improvements could be made to this device within the scope of the invention.

Among other things, it is possible to take advantage of the external surfaces of the rods 30 by equipping them with small brushes with aligned tufts of hair, thereby raising the hairs for better insertion into the adjacent tweezers.

In addition, it is possible to have the sliding shaft 10 be composed of a fixed central axle integral with the cradle 5, this axle being surrounded by a sleeve whose periphery has a toothing penetrated by slots.

Moreover, the curvature of the cross-shaped blade arms can be produced either by a constant slope of these arms, as illustrated in the drawings of FIG. 3, by an arched shape of the arms, or by a separation between the arms and the grasping zones as illustrated on the blades of FIG. 2. The dimensions listed in FIGS. 1 and 2 provide orders of magnitude but can, quite obviously, be optimized.

POSSIBILITIES FOR INDUSTRIAL APPLICATION

The invention applies to the technical field of depilatory devices, and more particularly to the field of household devices.

We claim:

1. A depilatory device comprising:

a casing provided to be held in a user's hand, said casing being provided with an opening constituting a window;

a motor;

a central shaft disposed behind said window and having a longitudinal axis; and a rotary roller mounted to be driven by said motor around the longitudinal axis of said central shaft, said roller comprising:

a first group of tweezer elements composed of a first series of side-by-side, parallel movable blades each having a base;

a second group of tweezer elements interposed between said first tweezer elements and each having a base; and control means for moving said movable blades of said first group of tweezer elements in translation along said central shaft so as to press tweezer elements of said first group against tweezer elements of said second group in order to grasp hairs that are to be plucked, wherein each of said blades is cross-shaped and has a first pair of arms that extend from said base along a first line that is perpendicular to the longitudinal axis and a second pair of arms that extend from said base along a second line that is perpendicular to the longitudinal axis and to the first line, said arms of said first pair being at least partly curved in a first direction parallel to the longitudinal axis and said arms of said second pair being at least partly curved in a second direction parallel to the longitudinal axis and opposite to the first direction.

2. The depilatory device according to claim 1, wherein:

said control means are operative for moving each of said blades in translation over a first distance along said central shaft; and each of said arms is curved to project parallel to the longitudinal axis by a distance equal to between one-third and two-thirds of the first distance.

3. The depilatory device according to claim 2, wherein the distance by which each of said arms projects is one-half of the first distance.

4. The depilatory device according to claim 1, wherein:

said second group of tweezer elements is composed of a second series of parallel blades;

each of said blades of said second series is cross-shaped and has a first pair of arms that extend from said base along a first line that is perpendicular to the longitudinal axis and a second pair of arms that extend from said base along a second line that is perpendicular to the longitudinal axis and to the first line, said arms of said first pair being at least partly curved in a first direction parallel to the longitudinal axis and said arms of said second pair being at least partly curved in a second direction parallel to the longitudinal axis and opposite to the first direction; and each arm of each said blades of said second series is disposed adjacent to, and is at least partly curved in a direction opposite to, a respective arm of a respective blade of said first series.

5. The depilatory device according to claim 1, wherein each of said arms has a peripheral portion that extends at an angle of between 1° and 15° relative to a plane perpendicular to the longitudinal axis.

6. The depilatory device according to claim 1, wherein each of said arms has a first portion connected to said base of the respective blade and a peripheral portion constituting a grasping zone and having a width greater than the width of said first portion.

7. A depilatory device comprising:

a casing provided to be held in a user's hand, said casing being provided with an opening constituting a window;

a motor;

a central shaft disposed behind said window and having a longitudinal axis; and a rotary roller mounted to be driven by said motor around the longitudinal axis of said central shaft, said roller comprising:

a first group of tweezer elements composed of a first series of parallel movable blades each having a base and a plurality of peripheral grasping zones;

a second group of tweezer elements composed of a second series of parallel blades each having a base and a plurality of grasping zones, said blades of said second series being interposed between said blades of said first series; and control means for moving said blades in translation parallel to the longitudinal axis to press peripheral zones of said blades of said first series against peripheral zones of said blades of said second series, wherein:

said peripheral zones of each said blade are offset parallel to the longitudinal axis from said base of the respective blade;

said first series of blades is coupled to said central shaft for movement with said central shaft parallel to the longitudinal axis;

said roller further comprises a cage which surrounds said central shaft and is movable parallel to the longitudinal axis relative to said central shaft;

said second series of blades is coupled to said cage for movement with said cage parallel to the longitudinal axis; and said control means are coupled to said central shaft and to said cage for applying alternating translational movements in respectively opposite directions to said central shaft and said cage.

8. The depilatory device according to claim 7, wherein said central shaft is provided with slots for holding said bases of said first series of blades.

9. The depilatory device according to claim 7, wherein:

said cage comprises a plurality of rods extending along the longitudinal axis and having radially internal surfaces provided with slots for holding said bases of said second series of blades, each of said rods have ends; and said device further comprises first and second lateral flanges bordering said roller, and said ends of said rods are fixed at regular intervals to said flanges.

10. The depilatory device according to claim 9, wherein said control means comprise:

a first pair of cams in diametrically opposed sectors of a circle fixed to said first flange;

a second pair of cams interposed between said first pair of cams in diametrically opposed sectors of a circle fixed to a first end of said shaft;

a casing facing one of said flanges;

a diametrical pair of wheels mounted on said casing and acting counter to said second pair of cams; and elastic return means acting on said cage and said shaft.

11. The depilatory device according to claim 10, wherein:

each of said blades has a plurality of curved arms and each of said arms carries a respective on of said grasping zones;

each arm of each of said blades is curved in a direction parallel to the longitudinal axis and each arm of each of said blades of said first series is disposed adjacent to, and is curved in a direction opposite to, a respective arm of a respective blade of said second series; and said control means further comprise:

a third pair of cams on sectors of a circle fixed to said second flange, and a fourth pair of cams in sectors of a circle fixed to a second end of said shaft and interposed between said cams of said third pair, wherein said cams of said third and fourth pairs are offset by a quarter turn from said cams of said first and second pairs.

* * * * *